United States Patent [19]

Mims, Jr. et al.

[11] Patent Number: 5,067,587

[45] Date of Patent: Nov. 26, 1991

[54] SERVICE PLATFORM FOR MOBILE SCAFFOLDING UNIT

[75] Inventors: William F. Mims, Jr., 3805 Sandybrook Dr., Arlington, Tex. 76017; Richard T. Bramlett, Fort Worth; Kenneth G. Oatman, Arlington, both of Tex.

[73] Assignee: William F. Mims, Jr., Arlington, Tex.

[21] Appl. No.: 635,852

[22] Filed: Dec. 28, 1990

[51] Int. Cl.[5] ..... E04G 1/20; E04G 21/00

[52] U.S. Cl. ..... 182/63; 182/131; 182/145

[58] Field of Search ..... 182/131, 132, 145, 146, 182/63, 127

[56] References Cited

U.S. PATENT DOCUMENTS

| | | | |
|---|---|---|---|
| 3,437,174 | 4/1969 | Coblenz | 182/131 |
| 3,871,477 | 3/1975 | Kuest | 182/131 |
| 4,262,773 | 4/1981 | Basham | 182/132 |
| 4,293,054 | 10/1981 | Pieri | 182/131 |
| 4,809,814 | 3/1989 | St. Germain | 182/132 |

*Primary Examiner*—Reinaldo P. Machado
*Attorney, Agent, or Firm*—Geoffrey A. Mantooth; Arthur F. Zobal; James C. Fails

[57] ABSTRACT

The mobile scaffolding unit has a tower, a work platform and a service platform. The work platform can be resupplied by the service platform so as to maintain the work platform at a working elevation. The work and service platforms are located on the vertically orientated tower. Each platform is provided with electric motors to propel the platforms along the tower. The service platform is located below the work platform. The work platform has hatches in its deck for receiving cargo. The hatches are covered with doors. Cargo is located on raised platforms on the deck of the service platform. The service platform then moves up the tower to a position immediately beneath the work platform. The cargo is received by the hatches on the work platform as the service platform moves up the tower, wherein when the service platform is immediately below the work platform, the cargo is at the same level as the work platform deck. The cargo is then moved onto the work platform deck.

6 Claims, 2 Drawing Sheets

SERVICE PLATFORM FOR MOBILE SCAFFOLDING UNIT

FIELD OF THE INVENTION

The present invention relates to mobile scaffolding platforms that traverse up and down a tower.

BACKGROUND OF THE INVENTION

Scaffolding provides a temporary elevated platform that is used in the construction or repair of a building. Scaffolding provides a work platform where workers can access elevated portions of a wall, ceiling or roof. A typical use for scaffolding is the laying of masonry on the outside of a building.

One type of scaffolding utilizes a fixed framework to support the work platform. Once the scaffolding is erected, the work platform is fixed in elevation. To move the work platform up or down, the supporting framework must be rearranged by either adding additional framework to raise the platform or remove the upper portions of the framework to lower the elevation. Moving the work platform up or down is a time consuming procedure.

Another type of scaffolding utilizes a vertical tower structure. The work platform is mounted on the tower and is provided with motors to propel the work platform up and down the tower. This mobile scaffolding platform reduces the time needed to change elevations because the tower structure need not be rearranged for changing elevation. The work platform merely traverses up and down the tower.

The mobile work platform and tower arrangement have a maximum load limit. In a common commercial mobile work platform, the maximum load limit is about 8,000 pounds. For masonry work, this maximum load limit provides enough bricks for only a few hours of work. Consequently, the work platform must be reloaded frequently.

Thus, although the mobile work platform is an improvement over fixed scaffolding, it presents a problem in being resupplied. A typical day for a mobile work platform begins by loading the first load of bricks and workers onto the platform at ground level early in the morning. The lower platform then slowly climbs the tower to the work area, where the workers lay the bricks. When the load of bricks on the platform has been exhausted, the workers must stop and bring the empty platform back down to the ground to be reloaded. The round trip time to the ground for reloading and back to the work area may take as long as an hour because of the slow speed of travel of the work platform. Several such trips down to the ground for reloading in a single day reduces productivity because the workers are idled during this time.

One prior art method of resupplying the work platform at an elevated location involves bringing in a crane to lift cargo up to the work platform. While this technique reduces the number of trips to the ground by the work platform, it is expensive to implement because it requires additional heavy equipment and operators. Furthermore, there are situations where, due to the worksite, use of a crane is impracticable. Another prior art method of resupplying the work platform at elevated locations involves bringing the cargo up through the interior of the building. The cargo is brought out to the work platform, which is on the outside of the building, by window. This is a roundabout method of moving the cargo around and adds to the difficulty of loading the cargo. The implementation of this technique depends on the availability of a window. If there is no window through which to pass the cargo, then this technique cannot be used.

SUMMARY OF THE INVENTION

It is an object of the present invention to resupply a mobile work platform while maintaining the mobile work platform at the work elevation, so that the mobile work platform need not traverse back and forth to the ground for resupply.

The mobile scaffolding unit of the present invention includes tower means, a work platform and a service platform. The tower means is adapted to be vertically oriented when on location at a worksite. The tower means has securing means for securing the tower means in place at the worksite. The work platform is mounted onto the tower means. The work platform has first motor means for moving the work platform along the tower means. The work platform has a deck that is adapted to support cargo and workers. The deck has hatch means for receiving cargo. The service platform is mounted onto the tower means at a location beneath the work platform. The service platform has second motor means for moving the service platform along the tower means. The service platform has a deck that is adapted to support cargo, wherein the work platform can be resupplied by the service platform traversing the tower means and by loading cargo on the work platform through the hatch means from the service platform below.

In one aspect, the mobile scaffolding unit further includes elevating means for elevating the cargo and the service platform above the service platform deck so that cargo is at the same elevation as the work platform deck when the service platform is immediately beneath the work platform. The elevating means is located on the service platform deck and is aligned with the hatch means. In another aspect, the elevating means includes a raised platform located above the service platform deck and that is aligned with the hatch means. In another aspect, the elevating means includes a raised platform located above the service platform and fixed scaffolding that supports the raised platform. In still another aspect, the hatch means includes a door that is hinged to the work platform deck.

The mobile scaffolding unit of the present invention allows a work platform to be maintained at the elevation where it is needed, while providing a service platform to ferry men and materials to the work platform from the ground. Unlike the prior art, which requires the work platform to traverse back and forth to the ground, the mobile scaffolding unit of the present invention allows the work platform to be used efficiently and with a minimum of work stoppage by allowing the work platform to remain at its working elevation above the ground even during resupply. The service platform traverses up and down the tower and is used to resupply the work platform. The use of a service platform on the same tower as the work platform requires no additional ground support equipment. Furthermore, the reliability of the work platform and its associated electric motors is increased because of the reduced amount of travel along the tower. Furtherstill, by receiving the cargo from the service platform through an opening in the work platform, the cargo is safely and easily transferred from the service platform to the work platform. The service platform lifts the cargo up to the deck level of the work platform, wherein the cargo is simply moved onto the work platform deck.

DESCRIPTION OF PREFERRED EMBODIMENT

Figure 1:
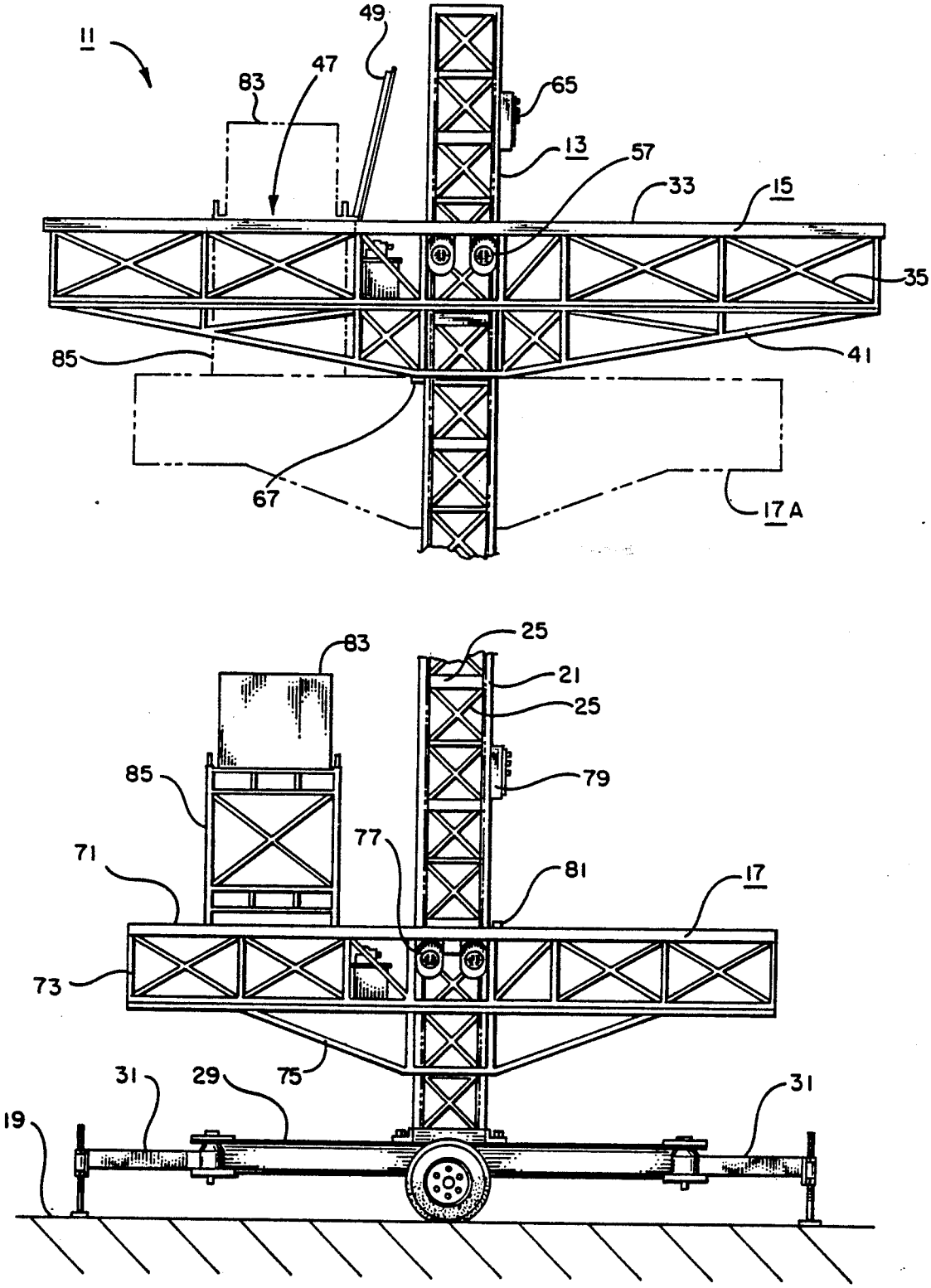
FIG. 1 is a front elevational view of the mobile scaffolding unit of the present invention, in accordance with a preferred embodiment.

In FIG. 1, there is shown a front elevational view of the mobile scaffolding unit 11 of the present invention, in accordance with a preferred embodiment. The mobile scaffolding unit 11 is typically located adjacent to an exterior wall of a building, and provides a platform for supporting workers and their materials for work on the building. The mobile scaffolding unit is mobile in the sense that the platform moves up and down between elevations along the wall. The mobile scaffolding unit of the present invention includes a tower 13, a work platform 15 and a service platform 17.

The tower 13 is a conventional commercially available structure. The tower is elongated and extends upwardly from the ground 19 to a point above the maximum working elevation. The tower 13 is generally square in transverse cross-section and has four corner posts 21, 23 (see FIG. 2). The corner posts are coupled together by horizontal and diagonal bracing 25. For ease of transport to and from the worksite, the tower is segmented into short lengths To assemble the tower, the segments are stacked one on top of another and coupled together. The length of the tower is determined by the number of segments used.

Two of the corner posts 21 are provided with gear teeth 27 (see FIG. 4) so as to form respective racks that extend the length of the tower. The tower racks are used by the work and service platforms 15, 17 to assist in their moving up and down the tower. The other two posts 23 are rectangular in transverse cross-section so as to serve as guides for the platforms.

The tower 13 is secured in place at the worksite to provide a stable arrangement for the platforms. The base of the tower 13 is mounted to a trailer frame 29. The trailer 29 is immobilized by four outriggers 31 which extend out diagonally from the corners of the trailer frame. The outriggers 31 are adjusted so as to bear on the ground 19. Lateral anchors (not shown) are provided along the length of the tower 13 to secure the tower to the building wall.

Figure 3:
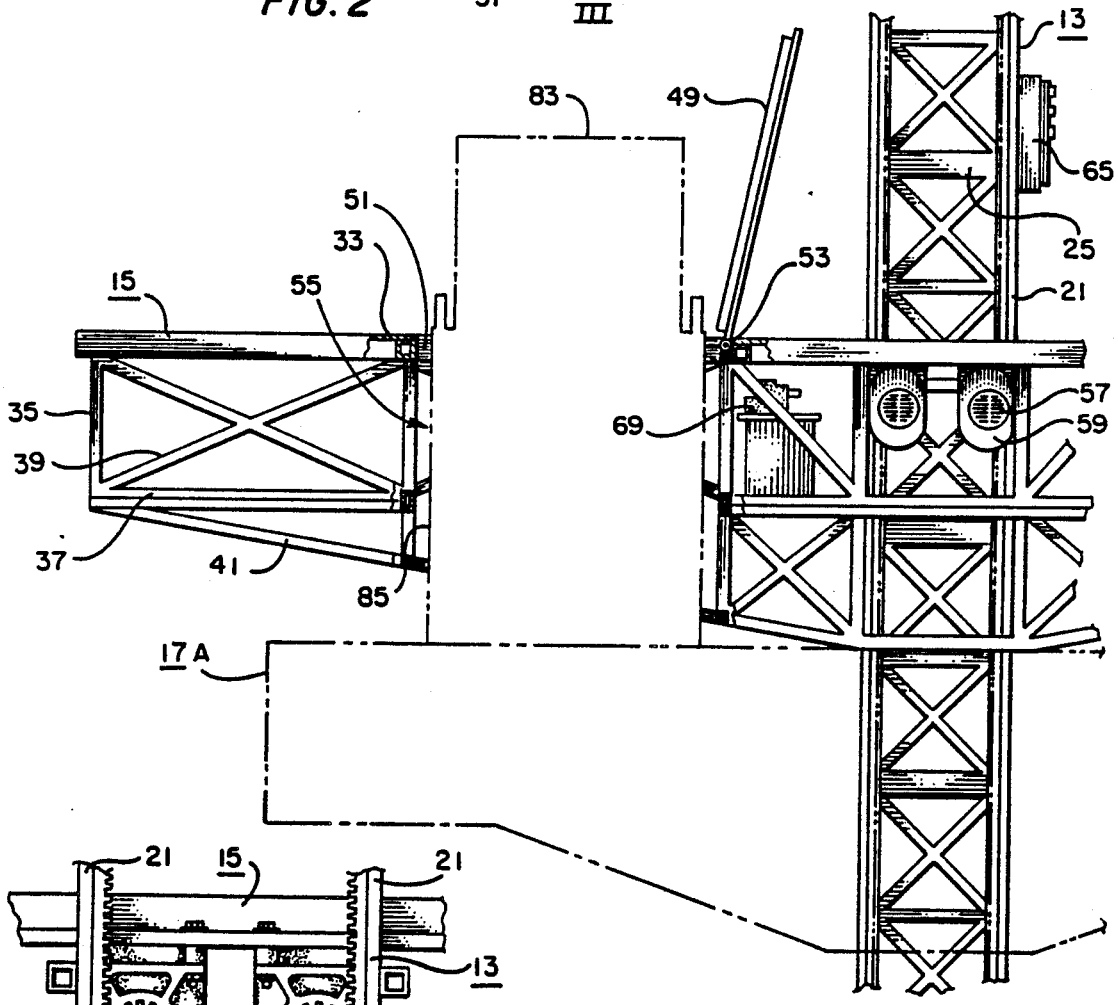
FIG. 3 is a close up partial cross-sectional view of one portion of the work platform, taken through lines III—III, shown with the service platform and a load in dashed lines.

The work platform 15 has a deck 33 that supports a load such as workmen and materials. Referring to FIG. 3, beneath the deck 33 is a truss 35 for supporting the deck. The truss 35 is generally rectangular in transverse cross-section and has four corner horizontal beams 37. The corner beams 37 are joined together by vertical and diagonal bracings 39. Some of the diagonal bracings extend to adjacent corner beams and some extend to the diagonally opposite corner beam. The work platform 15 also has a lower truss 41 beneath the rectangular truss 35. The lower truss 41 tapers upwardly from the center of the work platform to the ends of the work platform. The work platform 15 has a rectangular opening 43 for receiving the tower 13. The tower extends through the work platform as shown. The work platform is centered on the tower such that equal lengths of the work platform extend horizontally out from the tower. Referring to FIG. 3, the tower is located to the rear of the work platform so that workmen can walk from one end of the platform to the other end.

Figure 2:
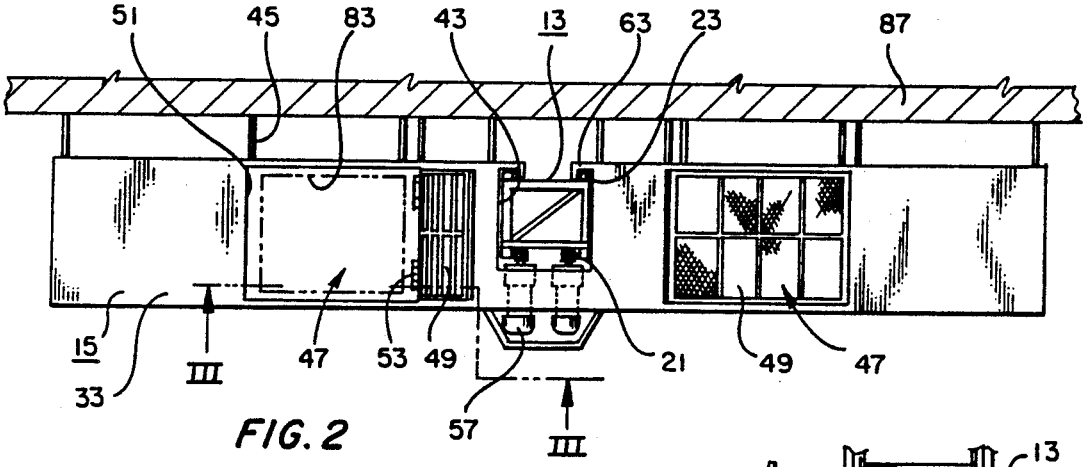
FIG. 2 is a top plan view of the work platform, showing the hatches for receiving cargo.

The work platform 15 is adapted to be easily lengthened. To lengthen the work platform 15, additional sections of deck and supporting truss are coupled to the respective ends of the work platform, in accordance with conventional practice The work platform also has extension beams 45 that extend rearwardly from the truss, as shown in FIG. 2. The extension beams 45 are used to support wooden boards that are used as decking, which decking extends between the work platform and the building wall.

Referring to FIGS. 2 and 3, the deck 33 is provided with two rectangular hatches 47 such that there is a hatch on each side of the tower 13. A hatch door 49 is provided to cover each hatch opening 51. Each hatch door 49 is made of steel bars coupled together and to a framework and covered with heavy duty steel mesh. The hatch doors 49 are coupled to the deck by hinges 53 to allow the hatch doors to be opened and closed. Beneath each hatch 47 is a hatchway or passageway 55 through the rectangular truss 35 and the lower truss 41. The passageway 55 is rectangular and of the same size as the hatch opening 51. The passageway allows cargo to pass through the work platform.

Figure 4:
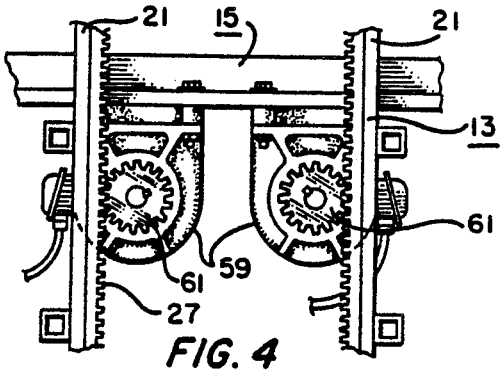
FIG. 4 is a close up rear elevational view of the electric motors and associated toothed rack of the tower.

The work platform 15 is provided with two electric motors 57 for moving the work platform up and down the tower 13 in accordance with conventional practice. The electric motors are coupled to respective transmissions 59, which are mounted to the work platform. The output of the transmissions are provided with gears 61 that engage the rack teeth 27 on the tower 13, as shown in FIG. 4. Thus, as the motors rotate the gears, the work platform moves up or down the tower. The gears 61 engage the two front corner posts 21 of the tower. The two rear posts 23 are used to guide and study the work platform. Roller guides 63 are provided on the work platform, which rollers bear on the surfaces of each rear corner post 23. A braking system is provided on the motors to prevent inadvertent movement of the work platform. The motors 57 are located beneath the deck. A controller 65 for controlling the motors 57 is provided. The controller 57 is mobile and is provided with a long cable that connects to the motors. An electric cable (not shown) connects the motors to a power source on the ground. The work platform 15 has a bottom limit switch 67 mounted on the lower truss work 41 near the tower. When actuated, the bottom limit switch 67 prevents the motors from moving the work platform down any further. The bottom limit switch is actuated by a surface located below the platform. The work platform is also provided with a hydraulic pump 69, located beneath the deck 33. The pump is used to operate a crane (not shown) that is mounted onto the work platform. The crane enables the mobile scaffolding unit to be self-erecting in that the crane can add tower segments during the installation of the tower.

The service platform 17 is mounted on the tower 13 so as to be below the work platform 15. The service platform 17 has a deck 71 and a supporting truss 73. The truss 73 is generally rectangular in transverse cross-section and is similar to the rectangular truss 35 of the work platform. In addition, the service platform 17 is provided with lower truss 75, located beneath the rectangular truss work. The lower truss 75 tapers upwardly. The service platform 17 has a rectangular opening in its center for receiving the tower 13. Thus, the service platform 17 extends out in both directions from the tower in a generally horizontal direction. The length of the service platform is such that the service platform extends to locations beneath the hatches 47 of the work platform 15. The service platform can be lengthened, if the need arises, in the same manner that the work platform is lengthened.

The service platform is provided with two electric motors 77 to propel the service platform up and down the tower 13. The motors 77 are configured in a substantially similar fashion to the motors of the work platform. A mobile hand held controller 79 is provided to operate the motors. A top limit switch 81 is mounted on the deck of the service platform near the tower. The top limit switch 81 is located so as to contact and be actuated by the lower truss work 41 of the work platform when the service platform is located immediately beneath the work platform. The top limit switch 81, when actuated, prevents the motors 77 from moving the service platform up any further.

The work and service platforms 15, 17 are provided with safety fencing that extends upwardly from the respective decks. The safety fencing, which is not shown in the drawings for clarity, acts as a guardrail for the workmen.

The operation of the mobile scaffolding unit 11 will now be described. As shown in FIG. 1, the work platform 13 is located at the selected elevation on the tower. For example, the mobile scaffolding unit could be used in masonry work on an exterior wall 87 of a building. Thus, the work platform is located at the elevation where the next course of brick is being laid. Because the work platform is limited in the load weight it can support, only enough brick for a few hours of work can be loaded onto it. Thus, the work platform must be resupplied with brick every few hours.

While the masons on the work platform 13 are working, the service platform 15 is loaded with brick 83 for transport up to the work platform. The service platform is located near the ground 19 for loading. Before loading brick onto the service platform, a raised platform 85 is provided on the deck of the service platform. In the preferred embodiment, the raised platform 85 is made up of conventional fixed scaffolding. After the raised platform has been positioned on the deck 71 of the service platform, the load 83 is placed on top of the raised platform using a forklift or some other loader. Typically, a raised platform and a load of bricks is loaded on each end of the service platform.

After the service platform 17 is loaded, an operator operates the controller 79 to raise the service platform up the tower 13. The service platform 17 is stopped at a location just beneath the work platform 13. As the service platform approaches the work platform, the operator moves out of the way the work platform trusses by climbing onto the work platform from the service platform. The operator takes the service platform controller 79 with him. The operator then raises the service platform until it is immediately beneath the work platform. The top and bottom limit switches 81, 67 prevent the service platform from jarring the work platform.

The hatch doors 49 on the work platform 15 are opened as the service platform approaches from below. As the service platform is raised, the loads 83 and the raised platforms 85 enter the respective passageways 55 through the work platform trusses. When the service platform (designated as 17A) is located immediately beneath the work platform, the loads 83 clear the deck 33 such that the top surfaces of the raised platforms are at the same level as the top surfaces of the deck 33 of the work platform. Then, the loads 83 are moved off of the raised platforms 85 and onto the work platform deck 33. The service platform 17 is then lowered and the hatch doors 49 are closed. In this manner, the work platform can be left at higher elevations while the service platform traverses between the work platform and the ground, ferrying materials and men up to the work platform.

The foregoing disclosure and the showings made in the drawings are merely illustrative of the principles of the invention and are not to be interpreted in a limiting sense.

We claim:

1. A mobile scaffolding unit, comprising:

(a) tower means adapted to be vertically oriented when on location at a worksite, said tower means having securing means for securing said tower means in place at said worksite;

b) a work platform mounted onto said tower means, said work platform having first motor means for moving said work platform along said tower means, said work platform having a deck that is adapted to support cargo and workers, said deck having hatch means therein for receiving cargo;

c) a service platform mounted onto said tower means at a location beneath said work platform, said service platform having second motor means for moving said service platform along said tower means, said service platform having a deck adapted to support cargo, wherein said work platform can be resupplied by said service platform traversing said tower means and by loading cargo on said work platform through said hatch means from said service platform below.

2. The mobile scaffolding unit of claim 1 further comprising elevating means for elevating cargo on said service platform above said service platform deck so that said cargo is at the same elevation as said work platform deck when said service platform is located immediately beneath said work platform, said elevating means being located on said service platform deck and aligned with said hatch means.

3. The mobile scaffolding unit of claim 2 wherein said elevating means comprises a raised platform located above said service platform and fixed scaffolding that supports said raised platform.

4. The mobile scaffolding unit of claim 3 wherein said hatch means comprises a door that is hinged to said work platform deck.

5. The mobile scaffolding unit of claim 1 wherein said hatch means comprises a door that is hinged to said work platform deck.

6. A mobile scaffolding unit, comprising:

a) tower means adapted to be vertically oriented when on location at a worksite, said tower means having securing means for securing said tower means in place at said worksite;

b) a work platform having a deck and a supporting truss beneath said deck, said work platform deck having an opening for receiving said tower means such that said work platform is mounted to said tower means, said work platform having first motor means for moving said work platform along said tower means, said work platform deck having a hatch opening and a hatch door for selectively closing said hatch opening, said work platform truss having a passageway therethrough beneath said hatch opening;

c) a service platform having a deck and a supporting truss beneath said deck, said service platform mounted onto said tower means at a location beneath said work platform such that said service platform deck is located beneath said hatch opening, said service platform having second motor means for moving said service platform along said tower means;

d) a fixed platform located on said service platform deck and being aligned with said hatch opening, said fixed platform having an elevation such that cargo loaded onto said fixed platform is at the same elevation as same work platform deck when said service platform is located immediately below said work platform, wherein said work platform can be resupplied by said service platform traversing said tower means and by loading cargo on said work platform through said hatch opening from said fixed platform and said service platform.

* * * * *